US005667173A

United States Patent [19]

Wilfong, Jr. et al.

[11] Patent Number: 5,667,173

[45] Date of Patent: Sep. 16, 1997

[54] COMPACT RACK CONSTRUCTION FOR MOUNTING T-SHIRT TYPE PLASTIC BAGS

[75] Inventors: Harry B. Wilfong, Jr.; Edwin W. Haenni, both of Hartsville, S.C.

[73] Assignee: Sonoco Products Company, Hartsville, S.C.

[21] Appl. No.: 558,963

[22] Filed: Nov. 13, 1995

[51] Int. Cl.[6] ..... B65B 67/04

[52] U.S. Cl. ..... 248/100; 248/99; 248/97; D6/566

[58] Field of Search ..... 248/100, 101, 248/99, 95, 175

[56] References Cited

U.S. PATENT DOCUMENTS

| | | | |
|---|---|---|---|
| Re. 33,264 | 7/1990 | Baxley et al. | 206/554 |
| D. 264,905 | 6/1982 | Adamson | D6/114 |
| D. 271,067 | 10/1983 | Prader | D6/114 |
| D. 273,159 | 3/1984 | Adamson et al. | D6/85 |
| D. 282,994 | 3/1986 | Prader | D6/566 |
| D. 298,714 | 11/1988 | Prader | D6/566 |
| 4,398,689 | 8/1983 | Prader | 248/99 |
| 4,458,867 | 7/1984 | Malik | 248/97 |
| 4,487,388 | 12/1984 | Provan | 248/97 |
| 4,840,335 | 6/1989 | Forman, Jr. et al. | 248/97 |
| 4,840,336 | 6/1989 | Stroh et al. | 248/97 |
| 4,858,862 | 8/1989 | Prader | 248/99 |
| 4,869,447 | 9/1989 | Malik | 248/97 |
| 4,881,706 | 11/1989 | Sedlik | 248/100 |
| 4,921,197 | 5/1990 | Benoit et al. | 248/97 |
| 4,981,216 | 1/1991 | Wilfong, Jr. | 206/554 |
| 5,020,750 | 6/1991 | Vrooman et al. | 248/97 |
| 5,074,674 | 12/1991 | Kuklies et al. | 383/8 |
| 5,092,548 | 3/1992 | Bayes et al. | 248/99 |
| 5,188,235 | 2/1993 | Pierce et al. | 206/554 |
| 5,190,253 | 3/1993 | Sable | 248/97 |
| 5,213,145 | 5/1993 | Huang et al. | 141/391 |
| 5,307,935 | 5/1994 | Kemanjian | 206/554 |
| 5,335,788 | 8/1994 | Beasley et al. | 206/554 |
| 5,362,152 | 11/1994 | Fletcher et al. | 383/8 |

*Primary Examiner*—Ramon O. Ramirez
*Assistant Examiner*—Willie Berry, Jr.
*Attorney, Agent, or Firm*—Bell, Seltzer, Park & Gibson P.A.

[57] ABSTRACT

A compact rack construction is provided for mounting a pack of thermoplastic grocery or retail product bags of the T-shirt type and which includes a frame and a pair of generally horizontally and outwardly extending laterally-spaced support arms for receiving the apertures in the handles of the bags in the pack at an outer end portion and for mounting the bag pack on a horizontal portion for consecutive opening and removal of the bags from the bag pack and from the rack. Each of the support arms include an upper surface and a lower surface extending horizontally from the frame to define the horizontal portion of the support arms therebetween and then extending upwardly from horizontal at predetermined different angles and being joined at outer ends to each other by a loop surface formed with a smooth radius to define the support arm outer end portion therebetween. The upward extension of said lower surface is offset forward with respect to the upward extension of said upper surface. This construction allows mounting of the bag pack on the support arms over the outer end portion, while providing a resistance to free movement of the handles of the bags off the outer end portion of the support arms.

16 Claims, 3 Drawing Sheets

COMPACT RACK CONSTRUCTION FOR MOUNTING T-SHIRT TYPE PLASTIC BAGS

FIELD OF THE INVENTION

This invention relates to a compact rack construction for-mounting a pack of thermoplastic grocery or retail product bags of the T-shirt type and which is adapted to be mounted to a vertical wall or the like at a check-out counter to conserve counter space.

BACKGROUND OF THE INVENTION

Plastic bags have been replacing paper bags in the United States since the 1970s for the grocery and retail product industries due to superior and inherent moisture resistant properties and strength of plastic, among other things. For these industries, these plastic bags usually are of the T-shirt type which include front and rear wall sections integrally connected by gussetted side walls and connected at the bottom to define a closed bottom on the bag. At least a part of the front and rear wall sections are open at the tops to define a mouth portion. Laterally spaced handles, integral with the front, rear and gussetted side wall sections, extend upwardly from opposed sides of the mouth portion and include mounting apertures of a predetermined length formed through the handles.

These types of bags for the grocery and retail product industries have been marketed by the assignee of the present invention as the highly commercially successful QUIK-MATE® bagging system, described in U.S. Pat. No. Re. 33,264, reissued Jul. 17, 1990. This system includes a plurality of such T-shirt bags formed into a bag pack and mounted on horizontally-extending support arms of the rack through the mounting apertures in the handles of the bag for being opened and loaded one-at-a-time and removed from the rack after being loaded.

The traditional grocery bag rack utilized with the above described system and with most other systems is designed to be self-supporting for sitting on top of a grocery counter check-out or other check-out counters and has evolved generally to the constructions shown in later issued U.S. Pat. Nos. 5,335,788 and 5,362,152, which are assigned to the assignee of the present invention. These prior rack constructions usually include a base portion designed to sit on a check-out counter or the like to render the racks self-supporting and the support arms are of a sufficient length so that the bags can be consecutively opened-up along the length of the support arms and loaded prior to removal from the support arms. The support arms are also spaced-apart a sufficient distance to maximize the mouth opening of the bag and generally position the bag handles at outwardly extending angles from the bag mouth. These prior rack constructions present problems in retail and convenience stores where space is a premium due to large items being checked-out or where there is not sufficient room for a bag rack system of this type. In these situations, it would be desirable to have a bag rack which could be mounted on a vertical wall, such as the inside of the check-out counter or the like, and which would be able to hold a bag pack for removal of these T-shirt bags one-at-a-time.

In light of the above problem, some rack manufacturers have recently put out a small rack, as shown in FIG. 1 hereof and labeled "Prior Art". This prior art rack construction, indicated at 110, includes a frame member 111 adapted to be attached to a vertical wall by screws or the like and has two short support arms 120 extending outwardly therefrom with looped outer end portions 122 for receiving and holding the handles H of a plurality of bags B forming a bag pack P through mounting apertures A in the bag handles H and which includes a central hook 113 for holding a central tab T of each of the bags B in the pack P. This rack 110 was adapted to be used by opening-up and removing the bags consecutively from the bag pack. When opening up of the bag, the handle portions attached to the front wall of the bag were removed from the rack support arms and the bag hung open on the rack from the handle portions attached to the rear wall of the bag for loading by the user and subsequently being removed entirely from the rack.

While this recently introduced prior art rack construction 110 helped with the space problems presented with earlier prior art racks where space was a premium at the check-out counter or the like, it presented other problems in that the bag handles of the bag pack tend to slide off the rack arms when the bag is opened-up and is being loaded by a user. This is caused because the looped outer end portions 122 of each rack support arm 120 is constructed to be of a width W generally equal to the length L of mounting apertures A in the handles of the bags B to allow mounting of the bag packs P on the rack 110. It should be understood that the width of the support arm W and the length L of the aperture A in the handles of the bag B are considered in a two dimensional sense as shown in the drawings and correspond, respectively, to the equivalent distance around the perimeter of the support arm and the mounting aperture of the bag handles.

OBJECT AND SUMMARY OF THE INVENTION

Accordingly, it is the object of this invention to overcome all of the above problems and provide a compact rack construction which solves the space problems presented with the earlier prior art rack constructions and which provides an outer end construction on the rack support arms which allows easy mounting of the bag packs on the rack, but which creates a resistance for free movement of the bag handles off the outer ends of the rack support arms.

By this invention, it has been found that the above objects may be accomplished by providing a rack for mounting a pack of thermoplastic grocery or retail product bags of the defined T-shirt type which includes generally the following construction.

A frame is provided, which is preferably of a size corresponding generally to the open area between the laterally-spaced handles of the bags and includes means for mounting the frame to a flat vertical surface. A pair of generally horizontally and outwardly extending laterally-spaced support arms are carried at one end by the frame and have a horizontal portion and an outer end portion for receiving the apertures in the handles of the bags in the pack at the outer end portions and for mounting the bag pack on the horizontal portion for consecutive opening-up for loading and subsequent removal of the loaded bags from the bag pack and from the rack.

Preferably, the lateral spacing of the support arms corresponds generally to the lateral spacing of the mounting apertures in the handles of the bags so that the handles of a bag pack extend upwardly in their natural shape when the bag pack is mounted on the rack. These support arms are preferably of a length less than the outwardly extending dimensions of a bag opened for loading and greater than the thickness of the bag pack. The frame of the rack preferably is of a size corresponding generally to an open area between the laterally-spaced handles of the bag and includes means for mounting of the frame to a flat vertical surface. With these dimensions and configuration, a compact rack construction is provided which may be attached to a vertical surface and which overcomes problems presented with space at the check-out counter or the like.

Each of the horizontal support arms comprise an upper surface and a lower surface. Each of the surfaces extends horizontally from the frame to define the support arm horizontal portion therebetween, and then extend upwardly from horizontal at predetermined different angles and are joined at their outer ends to each other by a loop surface formed with a smooth radius to define the support arm outer end portion therebetween. The upward extension of the lower surface is offset forward with respect to the upward extension of the upper surface. With the above construction, the bag packs may be easily mounted by sliding the mounting apertures in the handles thereof over the outer end portion of each of the support arms and a resistance is provided to free movement of the handles of the bags off the outer end portions of the support arms.

Preferably, the width of the outer end portion of each of the support arms measured parallel to the upwardly angled straight surface (referred to as the mounting width) is generally no greater than the predetermined length of the mounting apertures of the handles of the bags to permit easy mounting of the bag packs on the support arms. Preferably, the width of the free outer end portion of each of the support arms measured vertically of the support arm (referred to as the resistance width) is generally greater than the predetermined length of the mounting apertures of the handles of the bags to enhance the resistance to free movement of the bags off the support arms.

BRIEF DESCRIPTION OF THE DRAWINGS

Some of the objects and advantages of the invention have been set forth above and other objects and advantages of the invention will become apparent in the detailed description of preferred embodiments of the invention to follow, when taken in conjunction with the accompanying drawings, in which.

DETAILED DESCRIPTION OF PREFERRED EMBODIMENTS OF THE INVENTION

Figure 1:
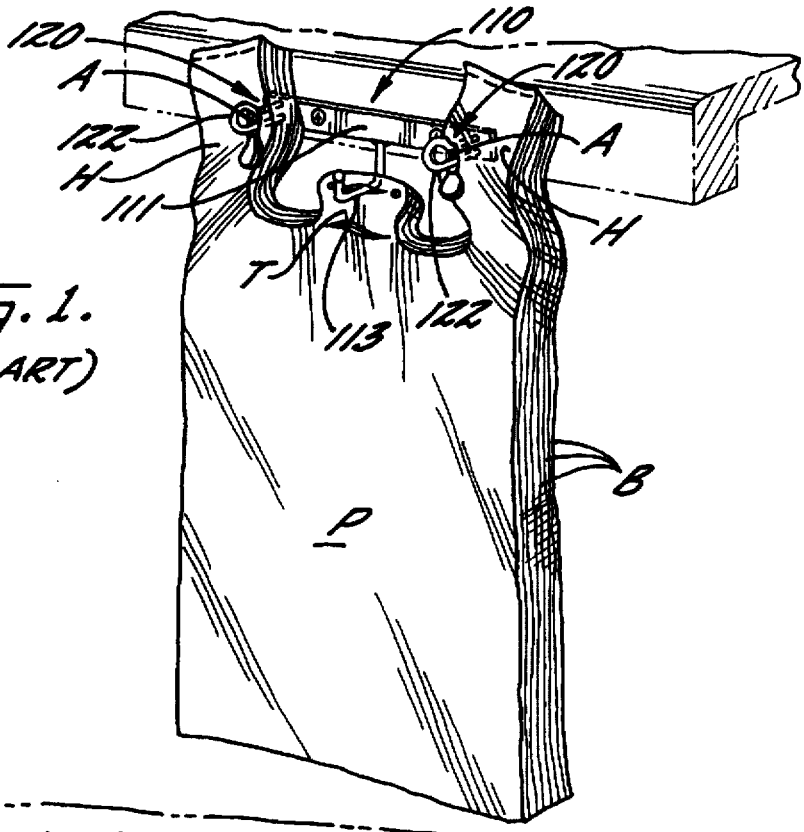
Fig. 1. (PRIOR ART)
FIG. 1 is a perspective view of the above described recently-introduced prior art compact rack construction for T-shirt grocery or retail bags and shown attached to a vertical wall surface and having a pack of T-shirt bags mounted thereon.
Figure 2:
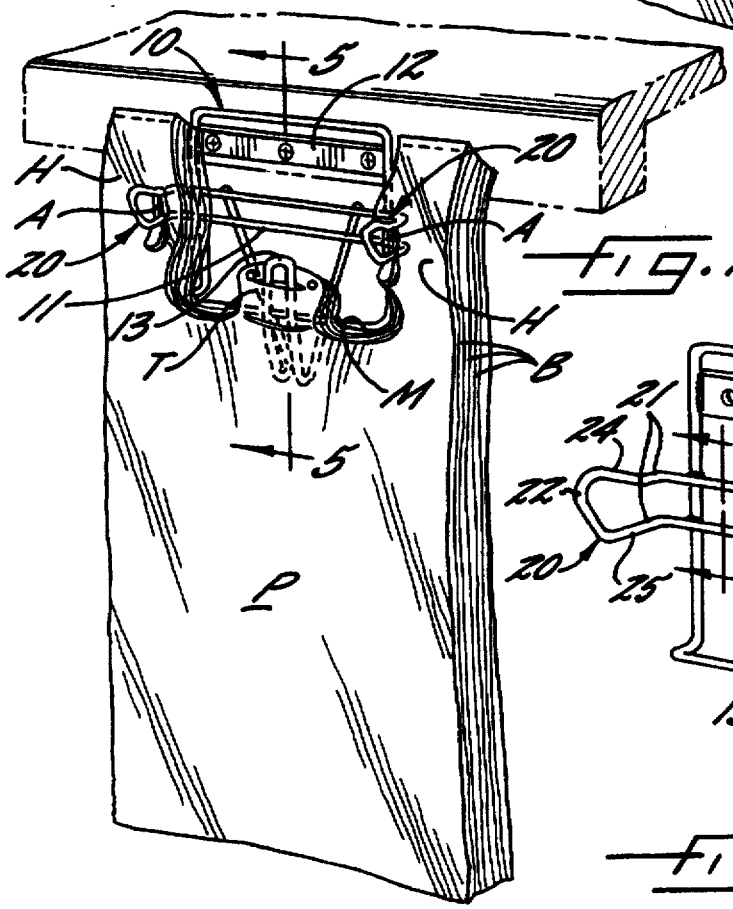
FIG. 2 is view, like FIG. 1, illustrating a first embodiment of the compact rack of the present invention.
Figure 3:
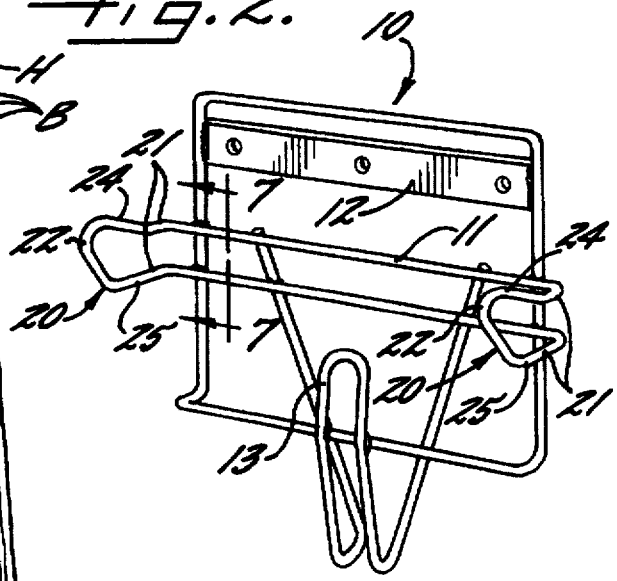
FIG. 3 is an enlarged perspective view of the rack of this invention shown in FIG. 2.
Figure 4:
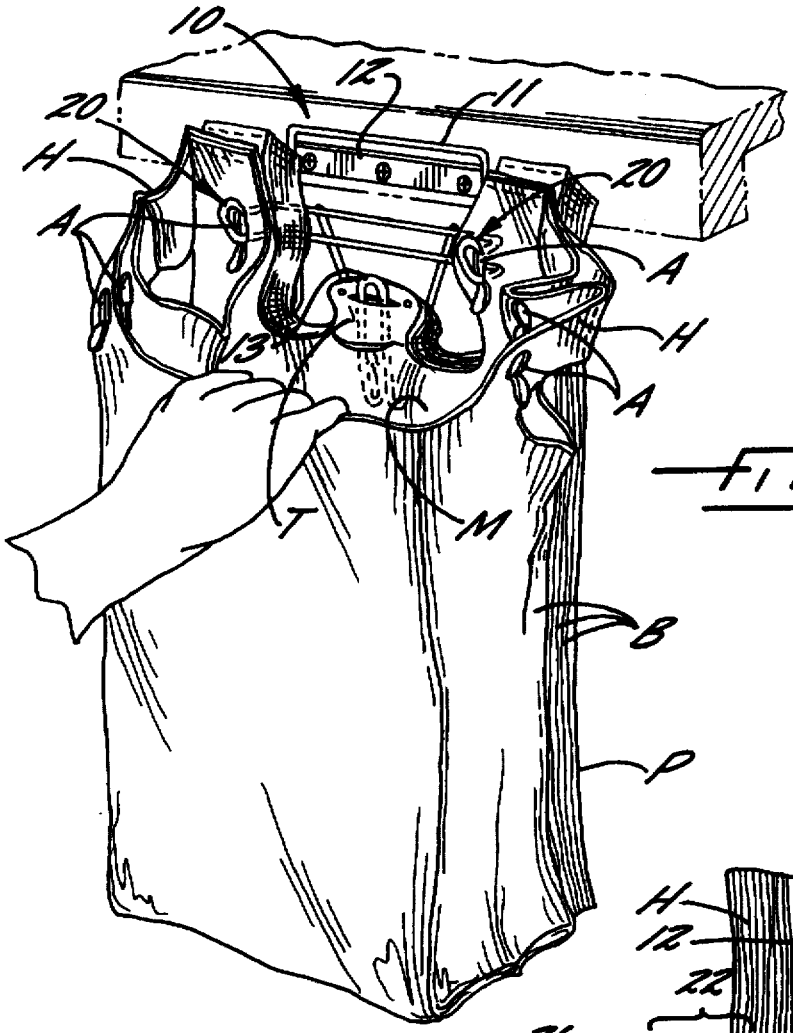
FIG. 4 is a view, like FIG. 2, illustrating the forward most bag of the bag pack in an open condition for loading.
Figure 5:
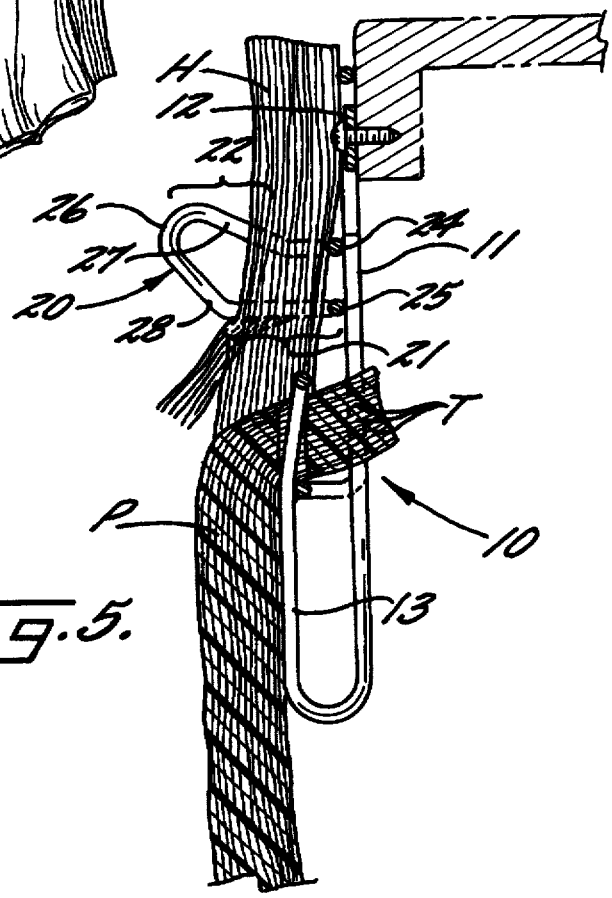
FIG. 5 is a partial sectional view, taken generally along the line 5—5 of FIG. 2.
Figure 6:
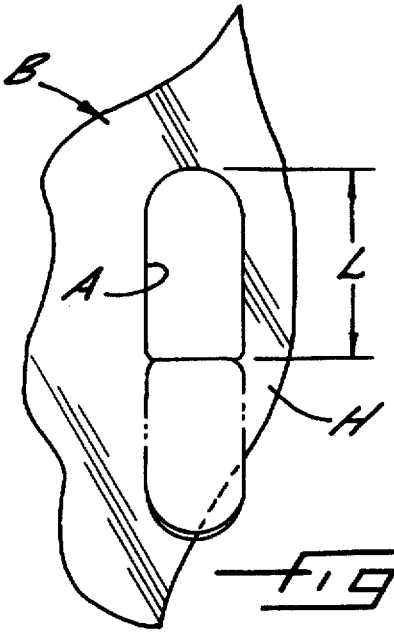
FIG. 6 is an enlarged partial side elevational view of a mounting aperture in one of the bags of the bag pack shown on the rack in FIGS. 2 and 5.

Referring now to the drawings, a prior art compact rack 110 which has recently been introduced by some rack manufacturers is illustrated in FIG. 1 and has been described generally above.

Figure 10:
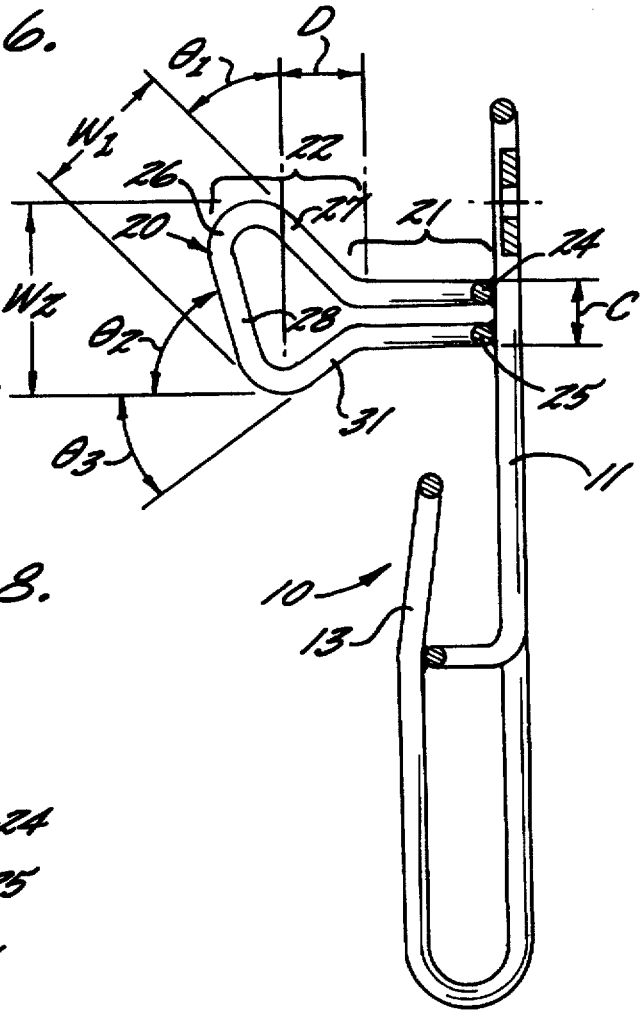
FIG. 10 is a sectional view, like FIG. 5 without the bag pack thereon, of a second embodiment of the compact rack of the present invention.

The improved compact rack construction of this invention, generally indicated at 10, is illustrated in FIGS. 2–10 with a first embodiment illustrated in FIGS. 2–9 and a second embodiment illustrated in FIG. 10. This rack 10 is adapted for mounting a pack P of thermoplastic grocery or retail product bags B of the T-shirt type, as shown particularly in FIGS. 2, 4 and 5. These T-shirt type bags B each include front and rear wall sections integrally connected by gussetted side walls and connected at the bottom to define a closed bottom on the bag (as shown generally in FIG. 4). At least a part of the front and rear wall sections are open at the top to define an open mouth portion M. Laterally spaced handles H, integral with the front, rear and gussetted side wall sections, extend upwardly from opposed sides of the mouth portion M and include mounting apertures A of a predetermined length L formed through the handle H.

The rack 10 of this invention includes a frame 11. This frame 11 is preferably constructed of a bent wire member or members and is of a generally rectangular shape and includes a plate 12 having screw holes therein for adapting the frame 11 to be mounted on a flat vertical surface by screws or the like. The size of this wire frame 11 preferably corresponds generally to the size of the open area between the laterally spaced handles H and above the open mouth M of the bags B (as shown generally in FIGS. 2 and 4) to cooperate with other features of the rack 10 to provide the desired compactness to the rack 10.

The frame 10 further includes a pair of generally horizontally and outwardly extending laterally-spaced support arms 20 carried at one end by the frame 11 and having a horizontal portion 21 and an outer end portion 22 for receiving the apertures A of the handles H of the bags B of the pack P at the outer end portion 22 and for mounting the bag pack P on the horizontal portion 21 for consecutive opening and removing of the bags B from the bag pack P and from the rack 10.

Each of the support arms 20 comprise an upper wire member 24 and a lower wire member 25 spaced from each other a predetermined distance C and defining upper and lower surfaces of the support arms. Each of these wire members 24, 25 extend horizontally at an inner end from the frame 11 to define the support arm horizontal portion 21 and are bent upwardly from horizontal at predetermined different angles $\theta_1$, $\theta_2$ near an outer end thereof and are joined at the outer end to each other by a loop portion 26 formed with a smooth radius to define the support arm outer end portions 22 which include upwardly angled upper and lower straight portions 27, 28 joined by the loop portion 26. The bend in the lower wire member 25 is off-set forward with respect to the bend in the upper wire member 24 by a distance D to define a longer upwardly angled straight portion 27 on the upper wire member 24 than the upwardly angled straight portion 28 on the lower wire member 25 in the outer end portion 22 of the support arm 20. This construction provides a resistance to free movement of the handles H of the bags B off the outer end portions 22 of the support arms 20.

Preferably, the width $W_1$ or mounting width of the outer free end portion 22 of each of the support arms 20 measured parallel to the angled straight portion 27 of the upper wire 24 or measured at the angle $\theta_1$, which is the mounting angle, is generally no greater than the predetermined length L of the mounting aperture A of the bag packs on the support arms 20. The width $W_2$ or resistance width of the free outer end portion 22 of each of the support arms 20 measured vertically of the support arms 20 is generally greater than the predetermined length L of the mounting apertures A of the handles H of the bags B to enhance the resistance to free movement of the bags B off the support arms 20.

In order to accomplish the above preferred relationship of the mounting width $W_1$ of the outer free end portion 22 of each of the support arms 20 measured parallel to the angled straight portion 27 of the upper wire 24 and the resistance width $W_2$ of the outer free end portion 22 of each of the support arms 20 measured vertically of the support arm 20 with respect to the length L of the mounting apertures A of the handles H of the bags B, various dimensions and angles can be utilized. These relationships can be determined wherein $W_2=W_1/\cos\theta_1$ and $D=(W_2-C)\tan\theta_1$.

Figure 7:
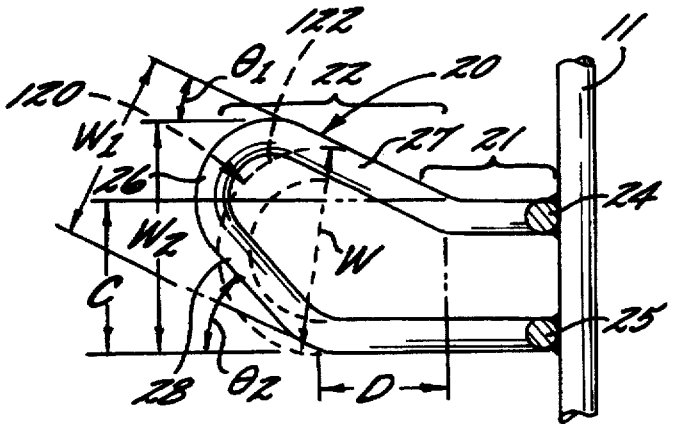
FIG. 7 is a sectional view, taken generally along the lines 7—7 of FIG. 3 and showing generally a side elevational view of one of the support arms of the rack of this invention and also showing a support arm in dotted lines and superimposed thereon of the prior art rack illustrated in FIG. 1.
Figure 8:
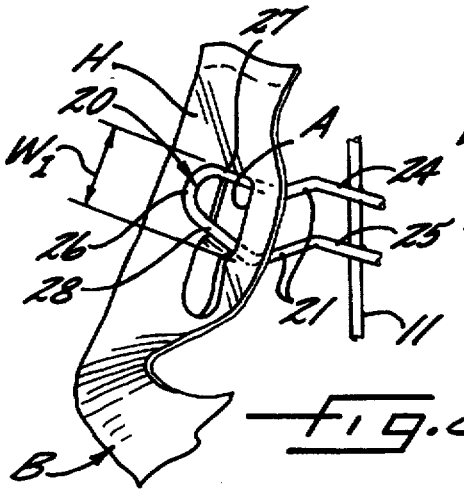
FIG. 8 is a perspective detail of one of the support arms of the rack of the present invention showing a bag being mounted thereon.
Figure 9:
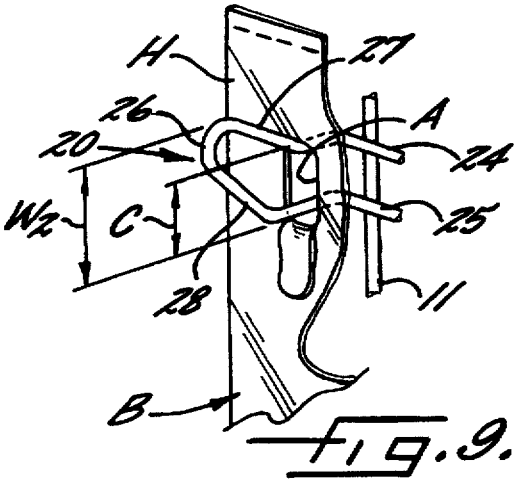
FIG. 9 is a perspective detail of one of the support arms of the rack of this invention showing a bag thereon and illustrating the resistance provided to free movement of the bag off the outer end of the support arm.

As illustrated in FIG. 7, a preferred relationship may be obtained wherein the length L of the apertures A in the handles H of the bags B is about 1.12" (the standard aperture length for most T-shirt bags of this type) and wherein the mounting width $W_1$ also equals 1.12 to allow the bags to be easily mounted onto the support arms 20 by sliding them on in a direction parallel to the angled straight portion 27 of the upper wire 24 (as shown in FIG. 8), and the resistance $W_2$ equals 1.19" to provide resistance to free movement of the handles of the bags off the outer free end portion 22 of the support arms 20 since this dimension resistance $W_2$ is greater than the length L of the aperture A of the handle H of the bag B (as shown in FIG. 9). With these specific dimensions, $\theta_1$ equals 26°, $\theta_2$ equals 48°, the spacing distance C equals 0.88" and the offset distance D equals 0.67". This is in contrast to the looped outer end portion 122 of the prior art rack of FIG. 1 (which is shown in dotted lines and in superimposed position in FIG. 7) wherein the width W of the free outer end portion 122 of the support arm 120 measured generally vertically of the support arm 120 is the same as (not greater than) the length L of the aperture A of the handle H of the bags B or 1.12" so that these apertures A may slide over the outer end portion 122 of the prior art rack 120. However, this dimension of the width W will not provide the desired resistance to the free movement of the bags B off the support arms 120.

Various relationships, other than the ones set forth in the previous paragraph, may also be utilized and obtain the advantages of the present invention. The following Table sets forth various acceptable relationships at mounting angles of 20°, 30°, 40° and 45° and wherein the mounting width equals 1.125".

| $\Theta_1$ | C | D | $W_1$ | $W_2$ | D + $W_2$ |
|---|---|---|---|---|---|
| 20 | 0.500 | 1.916 | 1.125 | 1.197 | 3.113 |
| 20 | 0.625 | 1.572 | 1.125 | 1.197 | 2.769 |
| 20 | 0.750 | 1.229 | 1.125 | 1.197 | 2.426 |
| 20 | 0.875 | 0.885 | 1.125 | 1.197 | 2.082 |
| 20 | 1.000 | 0.541 | 1.125 | 1.197 | 1.739 |
| 20 | 1.125 | 0.198 | 1.125 | 1.197 | 1.395 |
| 30 | 0.500 | 1.384 | 1.125 | 1.298 | 2.683 |

-continued

| $\Theta_1$ | C | D | $W_1$ | $W_2$ | D + $W_2$ |
|---|---|---|---|---|---|
| 30 | 0.625 | 1.167 | 1.125 | 1.298 | 2.466 |
| 30 | 0.750 | 0.951 | 1.125 | 1.298 | 2.250 |
| 30 | 0.875 | 0.734 | 1.125 | 1.298 | 2.033 |
| 30 | 1.000 | 0.517 | 1.125 | 1.298 | 1.816 |
| 30 | 1.125 | 0.301 | 1.125 | 1.298 | 1.600 |
| 40 | 0.500 | 1.154 | 1.125 | 1.468 | 2.622 |
| 40 | 0.625 | 1.005 | 1.125 | 1.468 | 2.473 |
| 40 | 0.750 | 0.856 | 1.125 | 1.468 | 2.324 |
| 40 | 0.875 | 0.707 | 1.125 | 1.468 | 2.175 |
| 40 | 1.000 | 0.558 | 1.125 | 1.468 | 2.026 |
| 40 | 1.125 | 0.409 | 1.125 | 1.468 | 1.877 |
| 45 | 0.500 | 1.091 | 1.125 | 1.590 | 2.681 |
| 45 | 0.625 | 0.966 | 1.125 | 1.590 | 2.556 |
| 45 | 0.750 | 0.841 | 1.125 | 1.590 | 2.431 |
| 45 | 0.875 | 0.715 | 1.125 | 1.590 | 2.306 |
| 45 | 1.000 | 0.590 | 1.125 | 1.590 | 2.181 |
| 45 | 1.125 | 0.465 | 1.125 | 1.590 | 2.056 |

$\Theta_1$ = MOUNTING ANGLE (degrees)
C = SPACING DISTANCE (inches)
D = OFFSET DISTANCE (inches)
$W_1$ = MOUNTING WIDTH (inches)
$W_2$ = RESISTANCE WIDTH (inches)

The compact rack 10 further includes a retaining means 13 for receiving and mounting a bag mounting tab T of the bags B through an aperture formed therein. This retaining means 13 preferably comprises a looped wire hook of sufficient length to provide a surface to support the bag mounting tabs from the rear when a bag on the front of the bag pack is engaged by a user to remove a bag from the bag pack and the rack (as may be seen in FIG. 4). This is in contrast to the hook 113 of the prior art rack 110, shown in FIG. 1, which does not provide this support surface.

Referring now to FIG. 10, a second embodiment of a preferred construction of the rack 10 of the present invention is set forth therein. This FIG. 10 utilizes like reference characters for those structural features of the second embodiment which are the same as the structural features utilized in the first embodiment of the invention illustrated in FIGS. 2–9 and a description of these like structural features will not be repeated now.

This second embodiment of a compact rack 10 of FIG. 10 differs from the first embodiment of compact rack 10 shown in FIGS. 2–9 in that the lower wire member is bent downwardly from horizontal at a predetermined angle designated as $\theta_3$ to define a downwardly angled straight portion 31 extending from the horizontal portions 21 to the upwardly extending bend and the upwardly angled straight portion 28. This extra bend and downwardly angled straight portion 31 increases the resistance to free movement of the aperture A of the handles H of the bags B off the support arms 20 of the rack 10. In the embodiment illustrated in FIG. 10, it has been found that the preferred relationship may be accomplished wherein $\theta_1$ is 45°, $\theta_2$ is 75°, $\theta_3$ is 36°, $W_1$ is 1.12", $W_2$ is 1.141", C=0.50" and D=0.66".

While the above preferred embodiments of the compact rack 10 of this invention have been described as utilizing upper and lower wire members to define upper and lower surfaces of the support arms, it is certainly within the scope of this invention to utilize other constructions of support arms, such as a solid stamp metal, molded plastic, etc. construction. Also, the frame of the rack 10 of this invention has preferably been described as being formed from wire members, it could also be formed from a stamped metal, molded plastic, etc. construction.

In the drawings and specification, there have been set forth preferred embodiments of this invention and although specific terms are employed, they are used in a generic and descriptive sense only and not for purposes of limitation. The scope of the invention is defined in the following claims.

What is claimed is:

1. A rack for mounting a pack of thermoplastic grocery or retail product bags of the T-shirt type having a pair of laterally-spaced handles extending upwardly from a body portion on either side of an open-mouth portion and having mounting apertures of a predetermined length through the handles, said rack comprising:

a frame;

a pair of generally horizontally and outwardly extending laterally-spaced support arms carried at one end by said frame and having a horizontal portion and an outer end portion for receiving the apertures in the handles of the bags in the pack at said outer end portion and for mounting the bag pack on said horizontal portion for consecutive opening and removal of the bags from the bag pack and from said rack; and each of said support arms comprising an upper surface and a lower surface, each of said surfaces extending horizontally outwardly from said frame to define said support arm horizontal portion therebetween and then extending upwardly from horizontal at predetermined different angles and being joined at outer ends to each other by a loop surface formed with a smooth radius to define said support arm outer end portion therebetween, the upward extension of said lower surface being outwardly offset from the upward extension of said upper surface, whereby a resistance to free movement of the handles of the bags off said outer end portions of support arms is created.

2. A rack, as set forth in claim 1, wherein a mounting width of said outer free end portion of each of said support arms measured parallel to said upwardly angled surface is generally no greater than the predetermined length of the mounting apertures of the handles of the bags to permit easy mounting of the bag packs on said support arms, and a resistance width of said outer free end portion of each of said support arms measured vertically of said support arm is generally greater than the predetermined length of the mounting apertures of the handles of the bags to enhance the resistance to free movement of the bags off said support arms.

3. A rack, as set forth in claim 2, in which said upper and lower surfaces of said support arm comprise upper and lower wire members extending respectively from said frame and joined at said loop surface at said outer end portion.

4. A rack, as set forth in claim 1, 2 or 3, wherein the lateral-spacing of said support arms corresponds generally to lateral spacing of the mounting apertures in the handles of the bags so that the handles of a bag pack extend upward in their natural shape when the bag pack is mounted on the rack.

5. A rack, as set forth in claim 1, 2 or 3, wherein said support arms are generally of a length less than the outwardly extending dimensions of a bag open for loading and greater than the thickness of the bag pack.

6. A rack, as set forth in claim 1, 2 or 3, wherein the lateral-spacing of said support arms corresponds generally to lateral spacing of the mounting apertures in the handles of the bags so that the handles of a bag pack extend upward in their natural shape when the bag pack is mounted on the rack and wherein said support arms are generally of a length less than the outwardly extending dimensions of the bag open for loading and greater than the thickness of the bag pack to provide a compact rack construction.

7. A rack, as set forth in claim 1, 2 or 3, wherein said frame is of a size corresponding generally to an open area between the laterally-spaced handles of the bags and includes means for mounting said frame to a flat vertical surface.

8. A rack, as set forth in claim 1, 2 or 3, wherein the lateral-spacing of said support arms corresponds generally to lateral spacing of the mounting apertures in the handles of the bags so that the handles of a bag pack extend upward in their natural shape when the bag pack is mounted on the rack, said support arms are generally of a length less than the outwardly extending dimensions of the bag open for loading and greater than the thickness of the bag pack, and said frame comprises a frame of a size corresponding generally to an open area between the laterally-spaced handles of the bags and includes means for mounting said frame to a flat vertical surface, whereby a compact rack construction is provided.

9. A rack, as set forth in claim 1, 2 or 3, wherein the T-shirt type bags in the bag pack each include a detachable mounting tab extending upwardly from the open-mouth portion and having a mounting aperture therein, and said rack further includes a bag mounting tab retaining means carried by said frame for receiving the apertures in the mounting tabs and mounting thereon the mounting tabs of the bags in the bag pack, said bag mounting tab retaining means comprising a hook of sufficient length and width to provide a surface to support the bag mounting tabs from the rear when a bag on the front of the bag pack is engaged by a user to remove a bag from the bag pack and the rack.

10. A rack, as set forth in claim 1, 2 or 3, wherein the horizontal portion of said lower surface of said support arms is longer than the horizontal portion of said upper surface of said support arms by a distance equal to the offset between the beginnings of the upward extensions of said upper and lower surfaces.

11. A rack, as set forth in claim 1, 2 or 3, wherein, said lower surface of said support arm includes a further portion extending downwardly from said horizontal portion to said lower upwardly extending surface of said outer end portion to further enhance the resistance to free movement of the handles of the bags off said outer end portions of said support arms.

12. A rack, as set forth in claim 7, wherein said frame comprises a wire frame.

13. A rack, as set forth in claim 2 or 3, wherein the angle of said upwardly extending surface of said outer end portion of said support arms equals $\theta_1$, the vertical width of said horizontal portion of said support arms equals C, the offset between the upward extension of said lower surface and the upward extension of said upper surface of said outer end portions of said support arms equals D, the mounting width of said outer end portion of said support arms measured parallel to said upwardly angled surface of said outer end portion of said support arms equals $W_1$, the resistance width of said outer end portion of said support arms measured vertically equals $W_2$, and wherein $W_2=W_1/\cos\theta_1$ and $D=(W_2-C)/\tan\theta_1$.

14. A compact rack for mounting a pack of thermoplastic grocery or retail product bags of the T-shirt type having a pair of laterally-spaced handles extending upwardly from a body portion on either side of an open-mouth portion and having apertures of a predetermined length through the handles and a detachable mounting tab extending upwardly from the open mouth portion and having a mounting aperture therein, said rack comprising:

a wire frame of a size corresponding generally to an open area between the laterally-spaced handles of the bags of the pack and including means for mounting said frame to a flat vertical surface;

a pair of generally horizontally and outwardly extending laterally-spaced support arms carried at one end by said frame and having a horizontal portion and an outer end portion for receiving the apertures in the handles of the bags in the pack at said outer end portion and for mounting the bag pack on said horizontal portion for consecutive opening and removal of the bags from the bag pack and from said rack, the lateral-spacing of said support arms corresponding generally to the lateral-spacing of the mounting apertures in the handles of the bags so that the handles of the bag pack extend upwardly in their natural shape when the bag pack is mounted on the rack, and said support arms being generally of a length less than the outwardly extending dimensions of the bag opened for loading and greater than the thickness of the bag pack;

each of said support arms comprising an upper wire member and a lower wire member, each of said wire members extending horizontally at an inner end from said frame to define said support arm horizontal portion and being bent upwardly from horizontal at predetermined different angles near an outer end thereof and joined at the outer end to each other by a looped portion formed with a smooth radius to define said support arm outer end portion having upwardly angled upper and lower straight portions joined by said looped portion, the bend in said lower wire member being outwardly offset from the bend in said upper wire portion to define a horizontal portion of said lower wire member longer than a horizontal portion of said upper wire member by a distance equal to the offset between the bends in said upper and lower wire member, a mounting width of said outer free end portions of each of said support arms measured parallel to said angled straight portions of said upper wire is generally no greater than the predetermined length of the mounting apertures of the handles of the bags to permit easy mounting of the bag packs on said support arms, and a resistance width of said outer free end portions of each of said support arms measured vertically of said support arms is generally greater than the predetermined length of the mounting apertures of the handles of the bags to enhance the resistance to free movement of the bags off said support arms; and a bag mounting tab retaining means carried by said frame for receiving the apertures in the mounting tabs and mounting thereon the mounting tabs of the bags in the bag pack and comprising a looped wire hook of sufficient length to provide a surface to support the bag mounting tabs from the rear when a bag on the front of the bag pack is engaged by a user to remove a bag from the bag pack and the rack.

15. A compact rack for mounting a pack of thermoplastic grocery or retail product bags of the T-shirt type having a pair of laterally-spaced handles extending upwardly from a body portion on either side of an open-mouth portion and having apertures of a predetermined length through the handles and a detachable mounting tab extending upwardly from the open mouth portion and having a mounting aperture therein, said rack comprising:

a wire frame of a size corresponding generally to an open area between the laterally-spaced handles of the bags of the pack and including means for mounting said frame to a flat vertical surface;

a pair of generally horizontally and outwardly extending laterally-spaced support arms carried at one end by said frame and having a horizontal portion and an outer end portion for receiving the apertures in the handles of the bags in the pack at said outer end portion and for mounting the bag pack on said horizontal portion for consecutive opening and removal of the bags from the bag pack and from said rack, the lateral-spacing of said support arms corresponding generally to the lateral-spacing of the mounting apertures in the handles of the bags so that the handles of the bag pack extend upwardly in their natural shape when the bag pack is mounted on the rack, and said support arms being generally of a length less than the outwardly extending dimensions of the bag opened for loading and greater than the thickness of the bag pack;

each of said support arms comprising an upper wire member and a lower wire member, each of said wire members extending horizontally at an inner end from said frame to define said support arm horizontal portion and being bent upwardly from horizontal at predetermined different angles near an outer end thereof and joined at the outer end to each other by a looped portion formed with a smooth radius to define said support arm outer end portion having upwardly angled upper and lower straight portions joined by said looped portion, the upward bend in said lower wire member being outwardly offset from the upward bend in said upper wire portion, said lower wire member further includes a downward bend from said horizontal portion to define a downwardly angled straight portion extending to said upwardly extending bend and said upwardly angled straight portion in said lower wire member, a mounting width of said outer free end portions of each of said support arms measured parallel to said angled straight portions of said upper wire is generally no greater than the predetermined length of the mounting apertures of the handles of the bags to permit easy mounting of the bag packs on said support arms, and a resistance width of said outer free end portions of each of said support arms measured vertically of said support arms is generally greater than the predetermined length of the mounting apertures of the handles of the bags to enhance the resistance to free movement of the bags off said support arms; and a bag mounting tab retaining means carried by said frame for receiving the apertures in the mounting tabs and mounting thereon the mounting tabs of the bags in the bag pack and comprising a looped wire hook of sufficient length to provide a surface to support the bag mounting tabs from the rear when a bag on the front of the bag pack is engaged by a user to remove a bag from the bag pack and the rack.

16. A rack, as set forth in claims 14 or 15, wherein the upward angle of bend from horizontal of said upper wire of said support arms equals $\theta_1$, the vertical width of said horizontal portion of said support arms equals C, the offset between the bends in said upper and lower wires of said support arm equals D, the mounting width of said outer free end portion of said support arms measured parallel to said upper wire angled straight portion equals $W_1$, the resistance width of said outer free end portion of said support arms measured vertically equals $W_2$, and wherein $W_2=W_1/\cos\theta_1$ and $D=(W_2-C)/\tan\theta_1$.

* * * * *